United States Patent [19]

Murasaki et al.

[11] Patent Number: 4,874,161

[45] Date of Patent: Oct. 17, 1989

[54] SHEET TRANSPORTING APPARATUS

[75] Inventors: Sadanobu Murasaki, Isehara; Hiroyuki Makiyama, Tokyo, both of Japan

[73] Assignee: Minolta Camera Kabushiki Kaisha, Japan

[21] Appl. No.: 124,955

[22] Filed: Nov. 18, 1987

[30] Foreign Application Priority Data

Nov. 19, 1986 [JP] Japan ..... 61-275578

[51] Int. Cl.[4] ..... B65H 5/16

[52] U.S. Cl. ..... 271/265; 271/270; 271/271

[58] Field of Search ..... 271/233, 269, 270, 271, 271/265

[56] References Cited

U.S. PATENT DOCUMENTS

| | | | |
|---|---|---|---|
| 3,672,667 | 6/1972 | Pahlitzsch | 271/270 X |
| 4,043,551 | 8/1977 | Morrison | 271/270 X |
| 4,213,604 | 7/1980 | Sato | 271/269 X |
| 4,487,407 | 12/1984 | Baldwin | 271/271 X |
| 4,665,408 | 5/1987 | Toriumi et al. | 346/134 |
| 4,688,785 | 8/1987 | Nubson | 271/271 X |

*Primary Examiner*—Richard A. Schacher

*Attorney, Agent, or Firm*—Wenderoth, Lind & Ponack

[57] ABSTRACT

A sheet transporting apparatus, for use in laser beam printers, CRT printers or the like wherein the apparatus transports a photosensitive sheet to an exposure station for forming images thereon. The apparatus includes a guide plate for guiding the sheet to the exposure station and a conveyor belt having levers on its outer surface for pushing the trailing edge of the sheet by movement of the lever along the guide plate. The levers cause the sheet to move initially at a speed V1 and then at a speed V2 which is less than a speed V0 at which the sheet is transported to a station for further processing of the sheet.

11 Claims, 5 Drawing Sheets

SHEET TRANSPORTING APPARATUS

BACKGROUND OF THE INVENTION

1. Field of the Invention

The present invention relates to a sheet transporting apparatus, and more particularly to a sheet transporting apparatus, for example, for use in laser beam printers, CRT printers or like printers wherein light is projected on a photosensitive sheet to form an image thereon while the sheet is being transported.

2. Description of the Prior Art

Laser beam printers have heretofore been proposed or provided wherein a photosensitive sheet being transported in a subscanning direction at an exposure station is scanned in a direction perpendicular to the subscanning direction with a laser beam modulated in accordance with an image signal to form an image on the sheet. With such printers, variations in the speed of transport of the sheet through the exposure station deviate the scanning beam relative to the sheet, impairing the quality of the image to be formed. It is therefore generally required of such printers that the sheet be transported with high precision.

U.S. Pat. No. 4,665,408 discloses a sheet transporting apparatus for transporting sheets accurately through an exposure station in the subscanning direction. To feed the sheet to transport means provided at the exposure station and adapted for precision transport, the disclosed apparatus includes a lever which is rotatable at a fixed position to push the sheet rear end and feed the sheet to the transport means, which in turn further transports the sheet through the exposure station.

With this apparatus, however, the lever, which is rotated at the fixed position, is adapted to feed sheets of a specified size only which corresponds to the distance between the lever and the transport means at the exposure station. Thus, the disclosed apparatus is usable for sheets of the specified size only.

Accordingly, the apparatus has the disadvantage of being unusable for sheets of altered size or for a strip of photosensitive material which is cut into a sheet of particular size in conformity with the size of the image to be formed.

Such a disadvantage has been encountered not only with the above-mentioned laser beam printers but also with CRT printers and like printers or further with other devices wherein sheets must be transported at a specified speed.

SUMMARY OF THE INVENTION

Accordingly, the main object of the present invention is to provide an apparatus for transporting a sheet with high precision free of variations in the speed of transport.

Another object of the invention is to provide an apparatus which is adapted to transport a sheet with high precision and high efficiency.

Another object of the invention is to provide an apparatus which is adapted to transport various long sheets with high precision.

Another object of the invention is to provide a sheet transporting apparatus which is best suited for use in laser beam printers or the like.

These and other objects can be fulfilled by a sheet transporting apparatus comprising:

transport means for transporting a sheet at a predetermined speed V0, a guide member provided upstream from the transport means with respect to the direction of transport of the sheet for guiding the sheet toward the transport means, and a projecting member movable from a start point to a terminal point along the guide member in the sheet transport direction for transporting the sheet toward the transport means by coming into contact with the rear end of the sheet during its movement and delivering the sheet to the transport means, the projecting member being movable at a speed V2 lower than the speed V0 when delivering the sheet to the transport means.

These and other objects, advantages and features of the invention will become apparent from the following description thereof taken in conjunction with the accompanying drawings which illustrate a specific embodiment of the invention.

BRIEF DESCRIPTION OF THE INVENTION

In the following description, like parts are designated by like reference numbers throughout the several drawings.

DETAILED DESCRIPTION OF THE INVENTION

An embodiment of the invention will be described below with reference to FIGS. 1 to 8. The laser beam printer shown in these drawings comprises a laser optical system 2 provided on the top of its main body 1 for projecting a laser beam on a photosensitive material 8 being transported to form a latent image thereon, and a developing unit 3 disposed in the lower portion of the main body 1 for converting the image to a visible image on the material 8.

Figure 1:
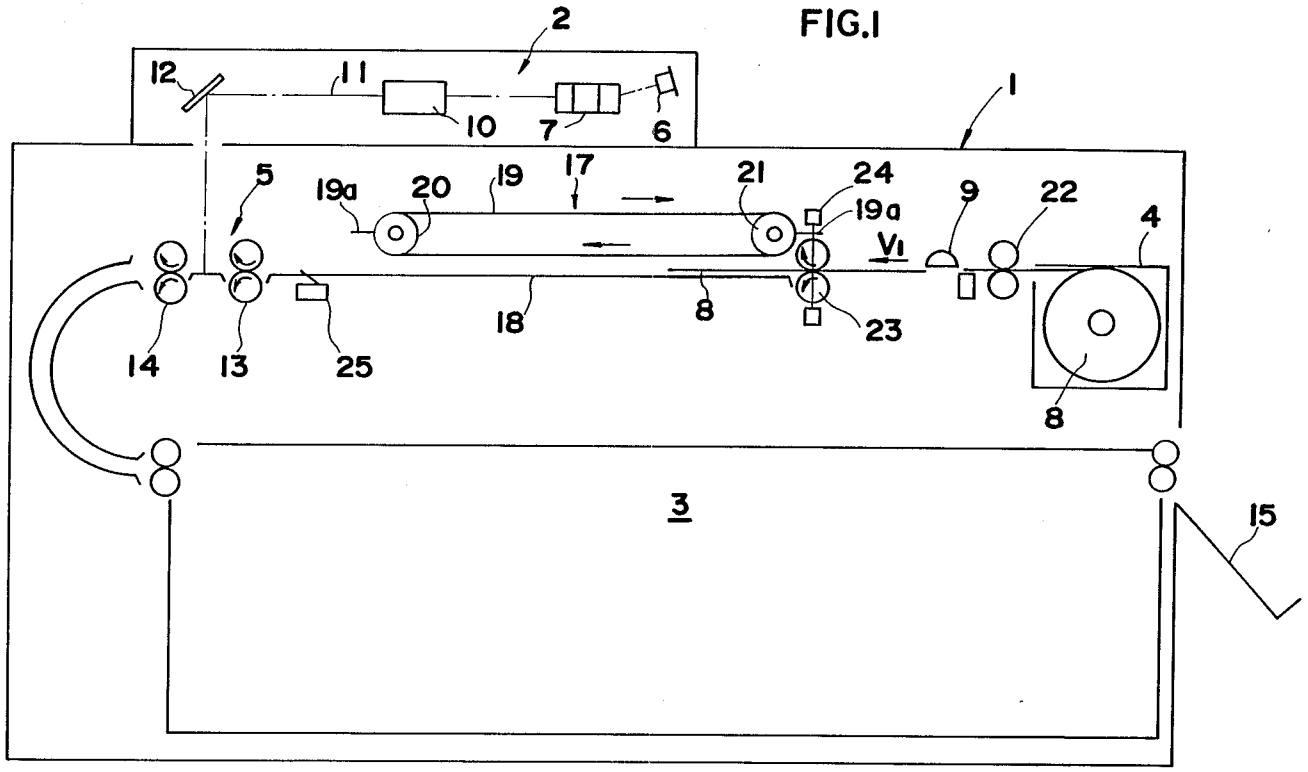
FIG. 1 is a sectional view schematically showing the construction of a laser beam printer having a sheet transporting apparatus of the invention incorporated therein.

FIG. 1 is a sectional view schematically showing the construction of the laser beam printer. The photosensitive material 8, which is, for example, a silver salt film or silver salt sensitized paper, is accommodated in the form of a roll within a supply magazine 4 installed in the printer main body 1. The material 8 is withdrawn from the supply magazine 4 by being transported by a pair of rollers 22 in nipping engagement therewith. The withdrawn material 8 is cut by a cutter 9 into a sheet, which is then forwarded to a conveyor 17 to be described later, by two pairs of rollers 23 which are arranged side by side transversely of the material 8. The length of sheet 8 to be cut off is variable, for example, in accordance with the size of image to be formed. A sheet of desired length is available by controlling when to operate the cutter 9 after the pair of rollers 22 starts withdrawing the material 9 from the supply magazine 4.

The photosensitive sheet 8 thus delivered to the conveyor 17 is transported by the conveyor 17 toward an exposure station 5 which is provided with two pairs of rollers 13 and 14. The sheet 8 forwarded by the conveyor 17 is further transported by the pairs of rollers 13, 14 at a predetermined speed with high precision. While being transported, the sheet 8 is exposed to the laser beam from the optical system 2 on the top of the main body 1, whereby an image is formed on the sheet 8. The optical system 2 includes a laser beam generator 6, a polygonal mirror 7, a lens 10 and a mirror 12. In accordance with an image signal from an external host system or the like, the generator 6 emits the laser beam 11, whereupon the beam 11 is swept horizontally by the polygonal mirror 7 rotating at a high speed to scan the traveling sheet 8 through the lens 10 and the mirror 12 in a direction perpendicular to the direction of transport of the sheet.

The sheet 8 having the image formed thereon at the exposure station 5 is transported to the developing unit 3, in which the sheet 8 is subjected to a developing process and then delivered onto a tray 15.

The construction of the conveyor 17 will be described below. The conveyor 17 comprises a guide plate 18 for guiding the sheet 8 as placed thereon substantially horizontally, and a conveyor belt 19 having two levers 19*a* on its outer surface for pushing the sheet 8 from behind while the sheet is being guided by the guide plate 18. The conveyor belt 19 is supported around a drive roller 20 and a driven roller 21 and has the two levers 19*a* which are spaced apart by one-half the belt perimeter. The drive roller 20 is drivingly rotated in the direction of an arrow shown in FIGS. 2–5; by unillustrated drive means to thereby drive the belt 19 in the direction of an arrow shown in FIG. 1. The levers 19*a* pass through a slit formed in the guide plate 18 in the direction of transport of the sheet 8.

The conveyor 17 of the above construction operates in the following manner. The pair of transport rollers 23 positioned immediately adjacent to the conveyor 17 upstream therefrom with respect to the transport direction transports the sheet 8 onto the guide plate 18 as seen in FIG. 1 at a high speed V1 irrespective of the speed V0 (i.e., V1 can be greater than, equal to, or less than V0) of transport by the pairs of rollers 13, 14 at the exposure station 5.

Figure 3:
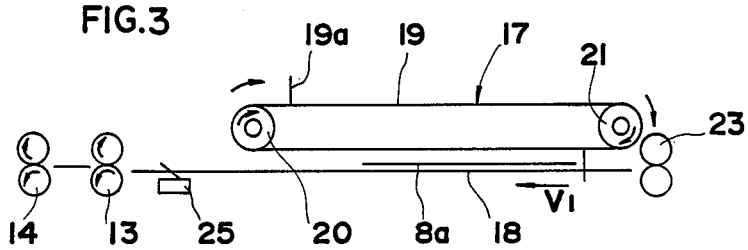

As the sheet 8 is further transported on the guide plate 18, a switch 24 disposed at the position of the roller pairs 23 detects the rear end of the sheet 8, whereupon the drive roller 20 is driven, driving the belt 19 at the speed V1. Consequently, one of the levers 19*a* on the belt 19 advances from its initial position shown in FIG. 1 between the juxtaposed pairs of rollers 23 and through the slit in the guide plate 18, pushing the rear end of the sheet 8 on the plate 18 forward toward the pairs of rollers 13, 14 as seen in FIG. 3.

Figure 4:
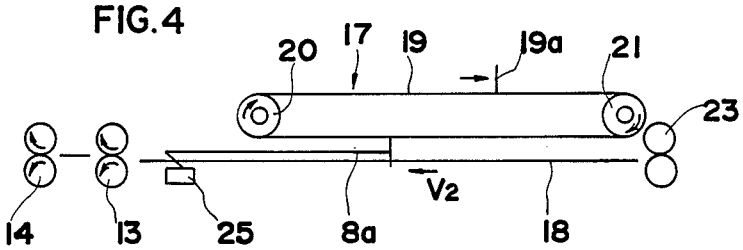
Figure 5:
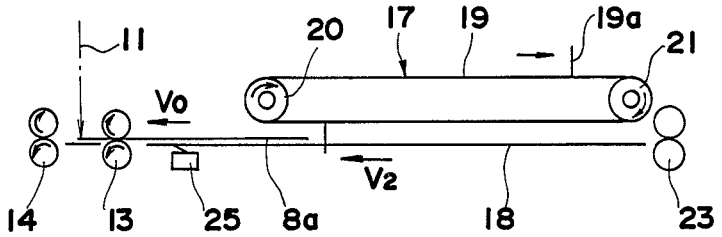

The leading end of the sheet 8 then reaches a speed adjusting position P4 at a distance l3 upstream from the pair of rollers 13 as shown in FIG. 4. This is detected by a switch 25, whereupon the driving speed of the drive roller 20 is changed to a speed V2 which is lower than the speed V0 of transport by the pairs of rollers 13, 14. As a result, the conveyor 17 feeds the sheet 8 to the pairs of rollers 13, 14 as shown in FIG. 5 at the lower speed V2.

The leading end of the sheet 8 is first nipped between the pair of rollers 13, whereupon the roller pair 13 starts to transport the sheet 8 at the speed V0 which is higher than the feed speed V2 of the conveyor 17. At this time, the rear end of the sheet 8 leaves the lever 19*a* as shown in FIG. 5 owing to the speed relation of $V0 > V2$. Accordingly, the lever 19*a* no longer acts on the sheet 8, allowing the pairs of rollers 13, 14 only to transport the sheet with high precision free of the influence of other members as seen in FIGS. 5 and 6 and permitting the laser beam 11 to form an image accurately.

With the embodiment described above, the speed of transport by the conveyor 17 is changed from the high speed V1 to the lower speed V2 at the position P4 upstream from the exposure station 5 to assure the printer of an improved operation efficiency, whereas the conveyor 17 may be adapted to transport the sheet 8 at the low speed V2 at all times without a speed change. Although the operation efficiency of the laser beam printer then lowers, the sheet is transported through the exposure station 5 at the same speed as already stated with good stability for accurate image formation.

Since the present apparatus has the construction described above, the distance between the position (start point) P1 where the conveyor 17 receives the sheet 8 from the pairs of rollers 23 serving as front transport means and the position P4 where the switch 25 is provided corresponds to the maximum length l2 of sheets which can be transported by the conveyor 17. The distance between the position P2 where the pair of rollers 13 is provided as the transport means and the position (terminal point) P3 where the conveyor 17 delivers the sheet 8 to the pair of rollers 13 at the exposure station 5 corresponds to the minimum length l1 of sheets 8 which can be transported by the conveyor 17. If a sheet longer than the length l2 is transported by the conveyor 17, the leading end of the sheet is nipped between the rollers 13 before the sheet rear end is released from the pairs of rollers 23. This permits the force of transport by the rollers 23 to influence the transport at the exposure station 5, resulting in the drawback of varying the speed of transport of the sheet at the exposure station 5. Further if a sheet shorter than the length l1 is transported, the sheet will be brought to a halt between the conveyor 17 and the pair of rollers 13. Accordingly, $l1 \leqq X \leqq l2$ wherein X is the length of sheets that can be handled by the laser beam printer.

Figure 6:
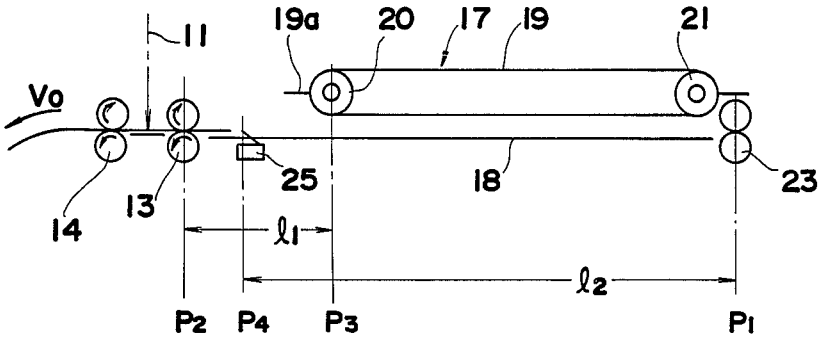

Further when the transport speed is changed at the position P4 upstream from the exposure station to improve the operation efficiency of the laser beam printer, it is required that the sheets to be used be not longer than the distance from the position Pl to the position P4 and not smaller than the distance from the position P2 to the position P3 (see FIG. 6).

Figure 7:
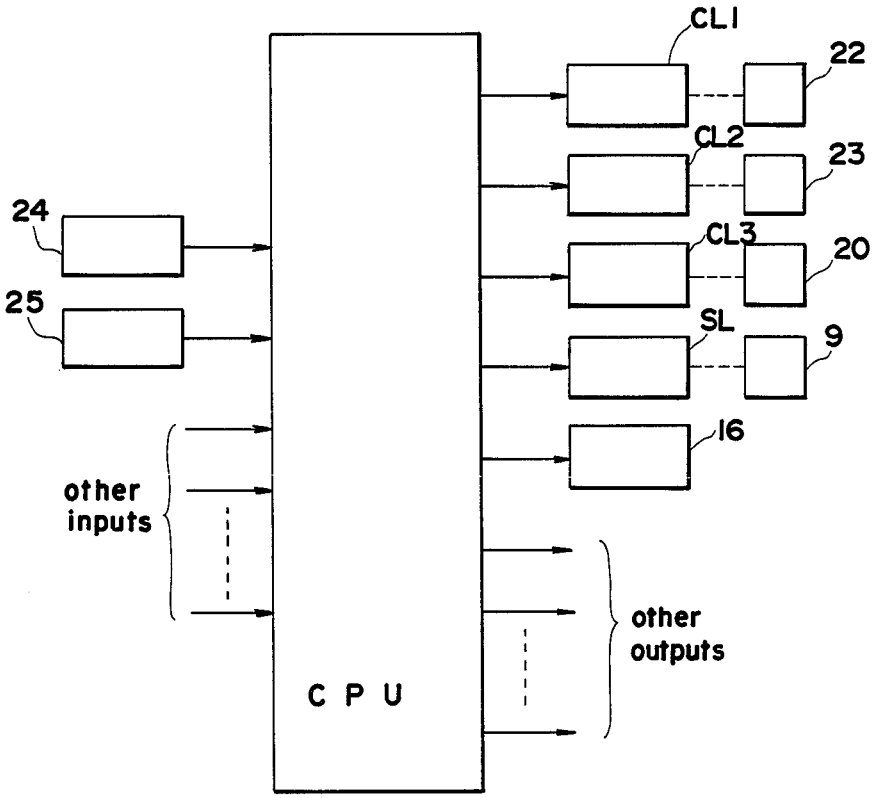
FIG. 7 is a block diagram showing the control circuit of the laser beam printer of FIG. 1.

FIG. 7 is a block diagram showing the control circuit of the laser beam printer of FIG. 1. Indicated at CPU is a microcomputer for receiving outputs from the switches, sensors, etc. at various portions of the printer to detect the state of the printer and control the printer. More specifically, the microcomputer CPU has input ports for receiving outputs from the switch 24 disposed at the position of the roller pairs 23 for detecting the rear end of the sheet 8, the switch 25 provided upstream from the exposure station 5 for detecting the leading end of the sheet 8, and other unillustrated switches, sensors, etc. Control signals are delivered from the output ports of the microcomputer CPU to a clutch CL1 for transmitting a drive force to the pair of rollers 22, a clutch CL2 for transmitting a drive force to the roller pairs 23, a clutch CL3 for transmitting a drive force to the drive roller 20, a solenoid SL for operating the cutter 9, and speed change means 16 for altering the drive speed of the drive roller 20.

Figure 8:
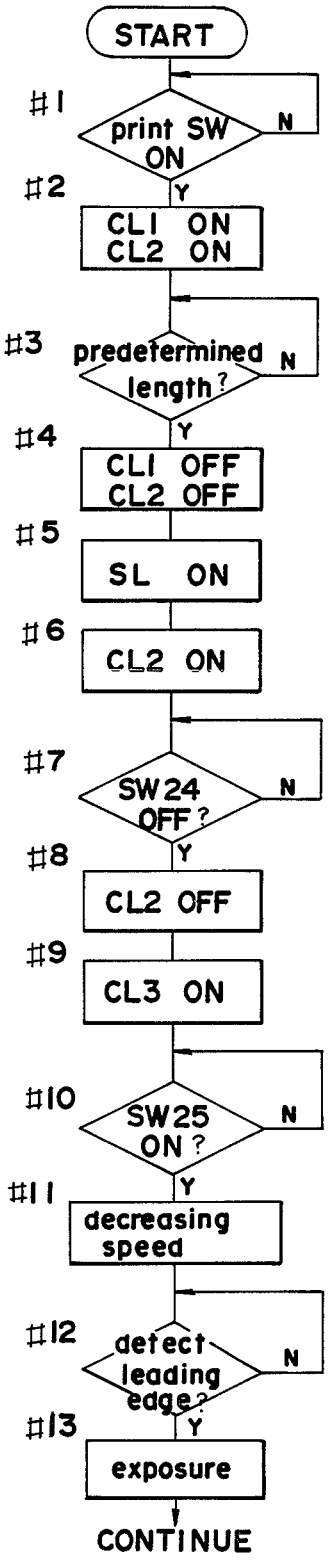
FIG. 8 is a flow chart showing a process for controlling the laser beam printer of FIG. 1.

FIG. 8 is a flow chart showing a process for controlling the printer components by the microcomputer CPU. First, when the depression of the print switch (not shown) is detected in step #1, the clutches CL1, CL2 are engaged in step #2 to drive the pairs of rollers 22, 23 at the speed V1, whereby a photosensitive material 8 is withdrawn from the supply magazine at the speed V1. Subsequently, step #3 inquires whether the material 8 has been withdrawn by a predetermined length, for example, with reference to the measurement of time required for the withdrawal. When the answer is in the affirmative, step #4 follows to disengage the clutches CL1, CL2 and temporarily stop the rollers 22, 23. In the next step #5, the solenoid SL is energized, causing the cutter 9 to cut off a sheet 8 of specified size from the material.

Figure 2:
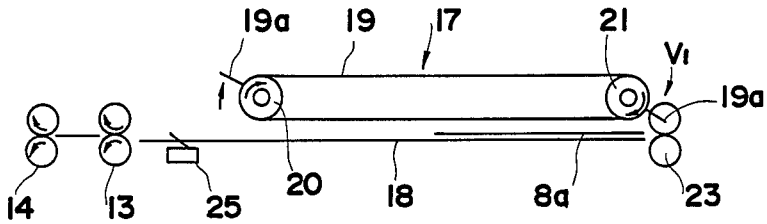
FIGS. 2 to 6 are diagrams showing a sheet being transported by the apparatus from position to position.

The sequence proceeds to step #6, in which the clutch CL2 is engaged again to drive the roller pairs 23 and transport the sheet 8 onto the guide plate 18 as seen in FIG. 2. Next, the rear end of the sheet 8 is detected by the switch 24 in step #7, whereupon the clutch CL2 is disengaged in step #8 to stop the roller pairs 23. Step #9 then follows, engaging the clutch CL3 to drive the drive roller 20 at the speed V1, causing the lever 19*a* of the conveyor 17 to transport the sheet 8 along the guide plate 18 at the speed V1 as shown in FIG. 3.

The leading end of the traveling sheet 8 then reaches the speed adjusting position P4, turning on the switch 25. When this is detected in step #10, a control signal is given to the speed change means 16 in step #11 to reduce the drive speed of the roller 20 to the speed V2. Consequently, the sheet 8 is further transported at the speed V2 which is lower than the speed V0 of transport by the pair of rollers 13, 14.

Subsequently, the leading end of the sheet 8 is brought into nipping engagement with the rollers 13 upon reaching the exposure station 5. When this is recognized in step #12, the projection of a laser beam is started at a specified time. After the sheet 8 has been nipped between the pair of rollers 13, the sheet 8 is transported at the speed V0 which is higher than the speed V2 of transport by the conveyor 17. Consequently, the rear end of the sheet 8 gradually moves away from the lever 19*a*. The sheet 8 can therefore be transported with high precision free of the influence of the lever 19*a*, permitting an image to be formed thereon very accurately.

The conveyor 17 is brought to a halt upon the lever 19*a* reaching a stand-by position for the next transport operation. In the case of the foregoing embodiment, the belt 19 has two levers 19*a* on its outer side, such that each lever is driven at a time over a distance corresponding to one-half the perimeter of the belt.

After passing through the exposure station 5, the sheet 8 is sent into the developing unit 3, in which the image is developed.

Although the conveyor 17 of the above embodiment comprises an endless belt having the levers on its outer surface, the conveyor means may have any desired construction insofar as the lever is repeatedly movable over the required stroke length along the path of transport.

The sheet transporting apparatus of the invention has been described above as embodied for use in a laser beam printer, whereas the invention is applicable also to other printers such as a CRT printer. The invention is of course applicable to other machines or devices wherein sheets must be transported with high precision.

Although the present invention has been fully described by way of example with reference to the accompanying drawings, it is to be noted that various changes and modifications will be apparent to those skilled in the art. Therefore, unless otherwise such changes and modifications depart from the scope of the invention, they should be construed as being included therein.

What is claimed is:

1. A sheet transporting apparatus comprising;

transport means for transporting a sheet at a predetermined speed V0;

a guide member provided upstream of said transport means with respect to a sheet transport direction for guiding the sheet toward the transport means; and a projecting member which is movable from a start point to a terminal point along the guide member in the sheet transport direction for urging the rear end of the sheet toward the transport means during its movement and delivering the sheet to the transporting means, said projecting member being movable initially from said start point to said terminal point at a speed V1 as the projecting member urges the sheet toward the transport means and then as a leading end of the sheet moves from a speed adjusting position to said transport means at a speed V2 lower than the speed V1 and lower than the speed V0.

2. A sheet transporting apparatus as claimed in claim 1, further comprising a drive roller, a driven roller, and a conveyor belt supported around the drive roller and the driven roller along the guide member, wherein one end of said projecting member is fixed on the outer surface of said conveyor belt.

3. A sheet transporting apparatus as claimed in claim 1, wherein V1 is not lower than V0.

4. A sheet transporting apparatus as claimed in claim 1, wherein the distance between said start point and said speed adjusting position corresponds to the maximum length of the sheet, and the distance between said terminal point and the transport means corresponds to the minimum length of the sheet.

5. A sheet transporting apparatus as claimed in claim 4, further comprising detecting means at the speed adjusting position for detecting the leading end of the sheet.

6. A sheet transporting apparatus for transporting a photosensitive sheet for use in an image recording apparatus including supplying means for supplying various lengths of the photosensitive sheet to said sheet transporting apparatus, said sheet transporting apparatus comprising:

transport means for transporting the sheet at a constant speed V0;

image formation means for scanning the sheet which is being transported by said transport means to form an image thereon;

a guide member, extending in a sheet transport path from said supplying means to said transport means, for supporting said sheet thereon; and a lever movable from a start point to a terminal point along the guide member in the sheet transport direction, said lever being movable at different speeds as it moves along the guide member, whereby said lever receives the sheet from said supplying means and urges the rear end of the sheet toward said transport means during its movement.

7. A sheet transporting apparatus as claimed in claim 6, wherein said lever initially moves at a speed V1 which is higher than said speed V0 upon receipt of the sheet from said supply means and then moves at a speed V2 which is lower than the said speed V0 or equal to the speed V0 when delivering the sheet to the transport means.

8. A sheet transporting apparatus as claimed in claim 7, further comprising a drive roller, a driven roller, and a conveyor belt supported around the drive roller and the driven roller along the guide member, wherein one end of said lever is fixed on the outer surface of said conveyor belt.

9. A sheet transporting apparatus as claimed in claim 6, wherein the distance between said start point and said transport means corresponds to the maximum length of the sheet, and the distance between said terminal point and the transport means corresponds to the minimum length of the film sheet.

10. A sheet transporting apparatus for transporting a photosensitive sheet for use in an image recording apparatus including supplying means for supplying various lengths of the photosensitive sheet to said sheet transporting apparatus comprising:

transport means for transporting the sheet at a constant speed V0;

image formation means for scanning the sheet which is being transported by said transport means to form an image thereon;

a guide member, extending in a sheet transport path from said supplying means to said transport means, for supporting said sheet thereon;

a lever mounted for projecting into and retracting away from the sheet transport path and moving from a start point to a terminal point along the guide member in the sheet transport direction when the lever is projected, whereby said lever receives the sheet from said supplying means and urges the rear end of the sheet toward said transport means during its movement along the sheet transport path; and a control means for changing the moving speed of the lever from a speed V1, which is higher than the speed V0 or equal to the speed V0, to a speed V2, which is lower than the speed V0, when the sheet reaches a speed adjusting position between the supplying means and the transport means by the movement of the lever.

11. A sheet transporting apparatus as claimed in claim 10, wherein the distance between said start point and said speed adjusting position corresponds to the maximum length of the sheet, and the distance between said terminal point and said transport means corresponds to the minimum length of the sheet.

* * * * *